US007571701B1

(12) United States Patent
Rice et al.

(10) Patent No.: US 7,571,701 B1
(45) Date of Patent: Aug. 11, 2009

(54) CAMSHAFT COVER WITH INTEGRATED INTAKE MANIFOLD

(75) Inventors: Alan E. Rice, New Baltimore, MI (US); Thomas Richard Durkin, Oxford, MI (US); Robert J. Moran, Ann Arbor, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 35 days.

(21) Appl. No.: 12/024,564

(22) Filed: Feb. 1, 2008

(51) Int. Cl.
*F01L 1/02* (2006.01)
*F02M 35/10* (2006.01)

(52) U.S. Cl. ..... 123/90.38; 123/184.31

(58) Field of Classification Search ..... 123/184.21, 123/184.28–184.37, 90.37, 90.38
See application file for complete search history.

(56) References Cited

U.S. PATENT DOCUMENTS 6,095,105 A * 8/2000 Lohr et al. ..... 123/184.31
6,167,855 B1 * 1/2001 Mammarella et al. .. 123/184.35

* cited by examiner

*Primary Examiner*—Noah Kamen
(74) *Attorney, Agent, or Firm*—Harness, Dickey & Pierce, P.L.C.

(57) ABSTRACT

An engine assembly may include an engine block, first and second cylinder heads, and first and second valvetrain covers fixed to the first and second cylinder heads. The engine block may include first and second cylinder banks disposed at an angle relative to one another to form a V-configuration. The first cylinder head may be fixed to the first bank and may include a first set of intake and exhaust ports. The second cylinder head may be fixed to the second bank and may include a second set of intake and exhaust ports. The first and second sets of exhaust ports may be located proximate a center of the V-configuration. The first valvetrain cover may include a first air inlet in communication with the first set of intake ports. The second valvetrain cover may include a second air inlet in communication with the second set of intake ports.

19 Claims, 5 Drawing Sheets

CAMSHAFT COVER WITH INTEGRATED INTAKE MANIFOLD

FIELD

The present disclosure relates to engine assemblies, and more specifically to air intake configurations for engine assemblies.

BACKGROUND

The statements in this section merely provide background information related to the present disclosure and may not constitute prior art.

Engine assemblies may include cylinder banks that are disposed at an angle relative to one another to form a V-configuration. The engine assembly may further include cylinder heads fixed to the banks that include intake and exhaust ports. The intake ports may face a center of the V-configuration and may be in communication with an intake manifold. The exhaust ports may be located on an outboard side of each of the banks.

SUMMARY

An engine assembly may include an engine block, first and second cylinder heads, and first and second valvetrain covers. The engine block may include a first bank defining a first set of cylinders and a second bank defining a second set of cylinders that is disposed at an angle relative to the first set of cylinders to form a V-configuration. The first cylinder head may be fixed to the first bank and may include a first set of head intake and exhaust ports. The first set of head exhaust ports may be located in an inboard side of the first cylinder head proximate a center of the V-configuration. The second cylinder head may be fixed to the second bank and may include a second set of head intake and exhaust ports. The second set of head exhaust ports may be located in an inboard side of the cylinder head proximate a center of the V-configuration. The first valvetrain cover may be fixed to the first cylinder head and may include a first air inlet in communication with the first set of head intake ports. The second valvetrain cover may be fixed to the second cylinder head and may include a second air inlet in communication with the second set of head intake ports.

In an alternate arrangement, an engine assembly may include an engine block, first and second cylinder heads, and first and second valvetrain covers. The engine block may include a first bank defining a first set of cylinders and a second bank defining a second set of cylinders. The first cylinder head may be fixed to the first bank and may include a first set of head intake and exhaust ports. The second cylinder head may be fixed to the second bank and may include a second set of head intake and exhaust ports. The first and second sets of head exhaust ports may face one another and the first and second sets of head intake ports may face away from one another. The first valvetrain cover may be fixed to the first cylinder head and may define a first intake manifold portion in communication with the first set of head intake ports and a first cam cover portion integrally formed with the first intake manifold portion and isolated from the first set of head intake ports. The second valvetrain cover may be fixed to the second cylinder head and may define a second intake manifold portion in communication with the second set of head intake ports and a second cam cover portion integrally formed with the second intake manifold portion and isolated from the second set of head intake ports.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
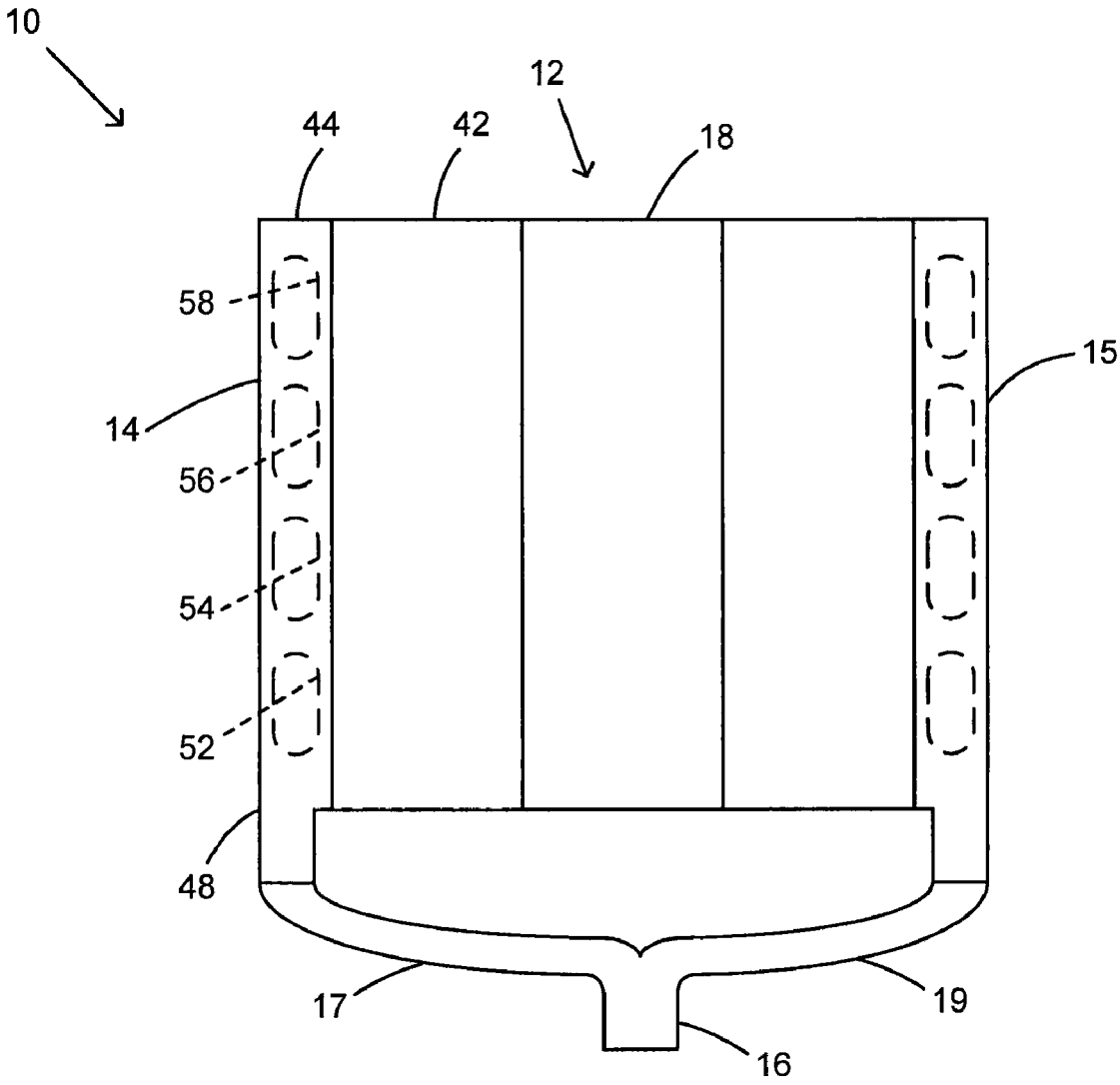
FIG. 1 is a schematic illustration of an engine assembly according to the present disclosure.

The following description is merely exemplary in nature and is not intended to limit the present disclosure, application, or uses. It should be understood that throughout the drawings, corresponding reference numerals indicate like or corresponding parts and features.

Figure 2:
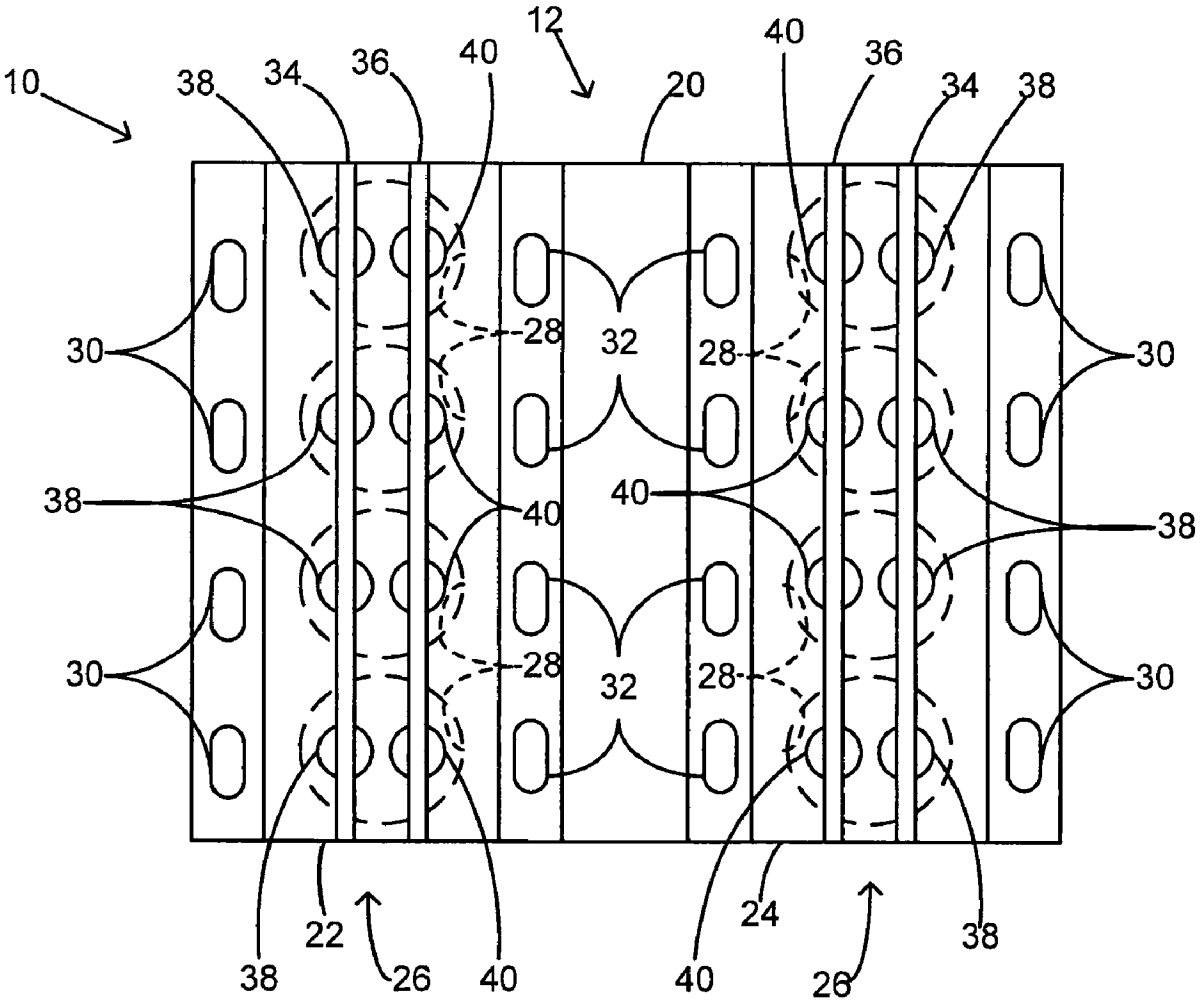
FIG. 2 is an additional schematic illustration of the engine assembly of FIG. 1.

Referring now to FIGS. 1 and 2, an exemplary engine assembly 10 is schematically illustrated. The engine assembly 10 may include an engine 12, first and second cover members 14, 15, an air intake plenum 16, and an exhaust manifold 18. With particular reference to FIG. 2, the engine 12 may include an engine block 20 having a V-configuration, first and second cylinder heads 22, 24, and a valvetrain assembly 26. The engine block 20 may include first and second cylinder banks that define first and second sets of cylinders 28 disposed at an angle relative to one another to form the V-configuration. Each of the first and second cylinder heads 22, 24 may include intake air ports 30 and exhaust gas ports 32. The intake air ports 30 may be located on an outboard side of each of the first and second cylinder heads 22, 24 and the exhaust gas ports 32 may be located on an inboard side of the each of the first and second cylinder heads 22, 24 and directed toward an inside of the V-configuration. As shown in FIG. 1, the air intake plenum 16 may include a first conduit 17 in communication with the first cover member 14 and a second conduit 19 in communication with the second cover member 15.

The valvetrain assembly 26 may include intake and exhaust camshafts 34, 36 and intake and exhaust valves 38, 40. The intake valves 38 may be in communication with the intake ports 30. The exhaust gas ports 32 may provide communication between the exhaust valves 40 and the exhaust manifold 18. While the engine assembly 10 is illustrated as an overhead cam engine, it is understood that the present disclosure may be applicable to a variety of other engine configurations as well including cam-in-block engines.

Figure 3:
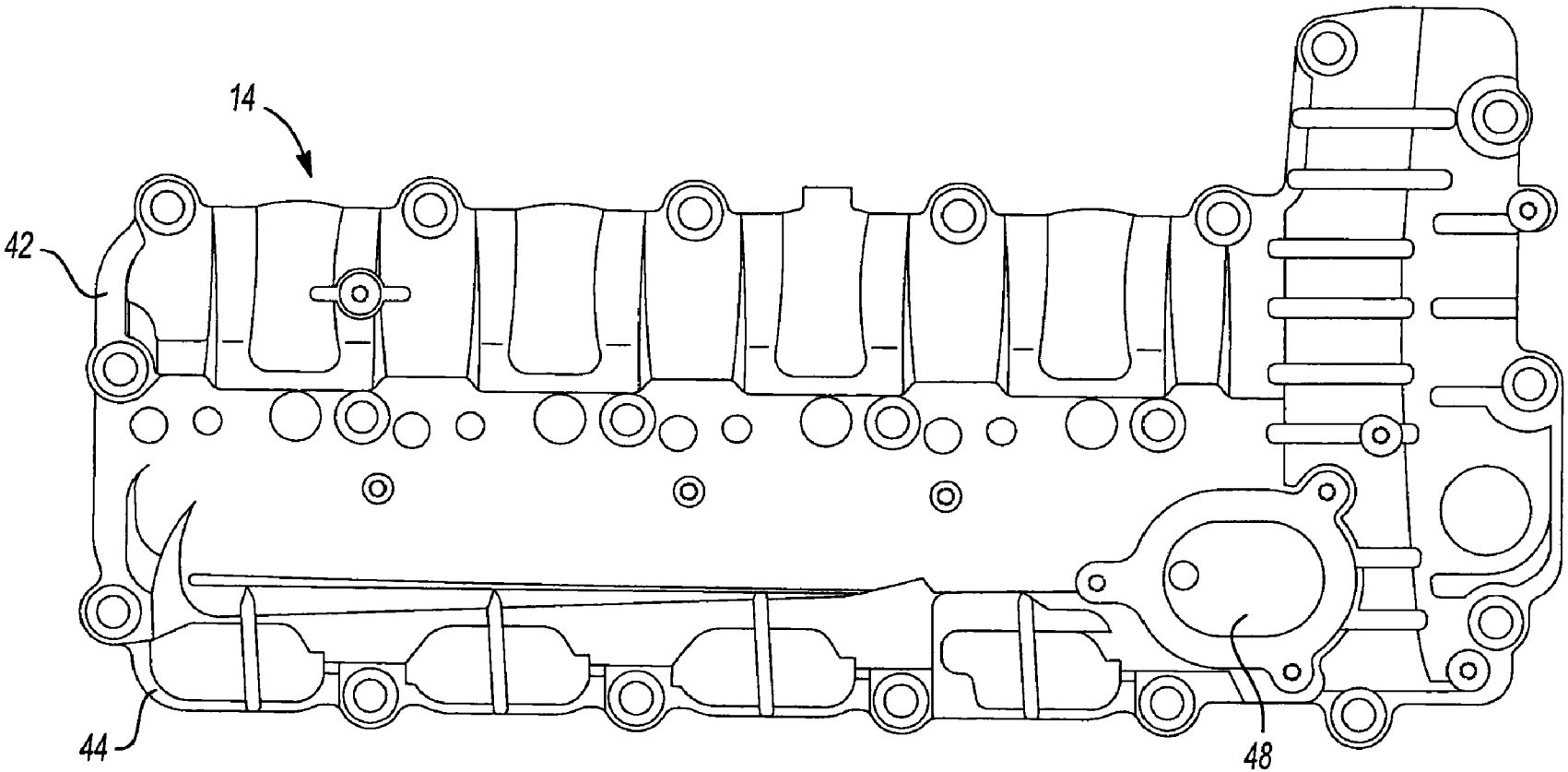
FIG. 3 is a top plan view of the cover member shown in FIG. 1.
Figure 4:
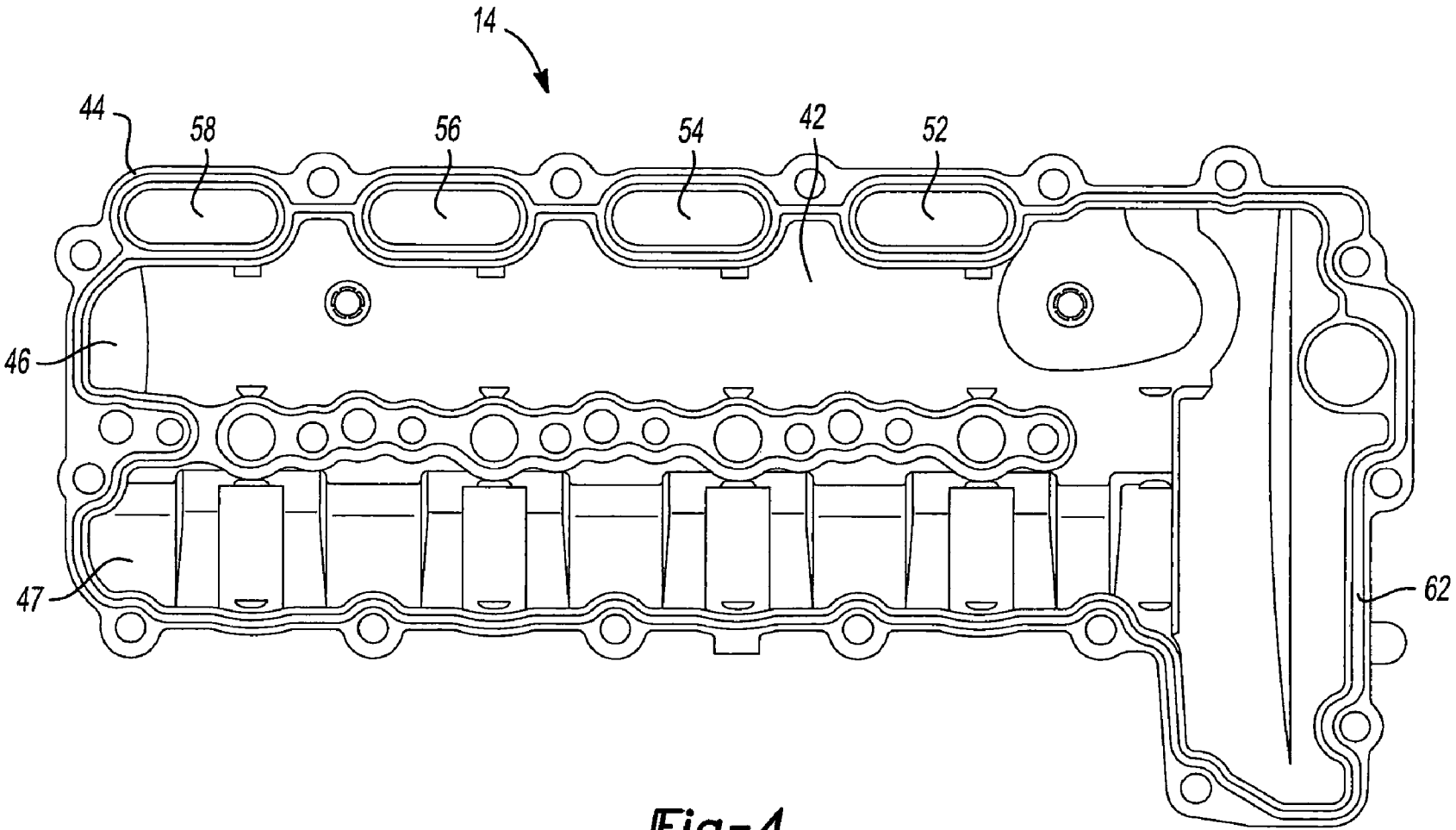
FIG. 4 is a bottom plan view of the cover member of FIG. 3.
Figure 5:
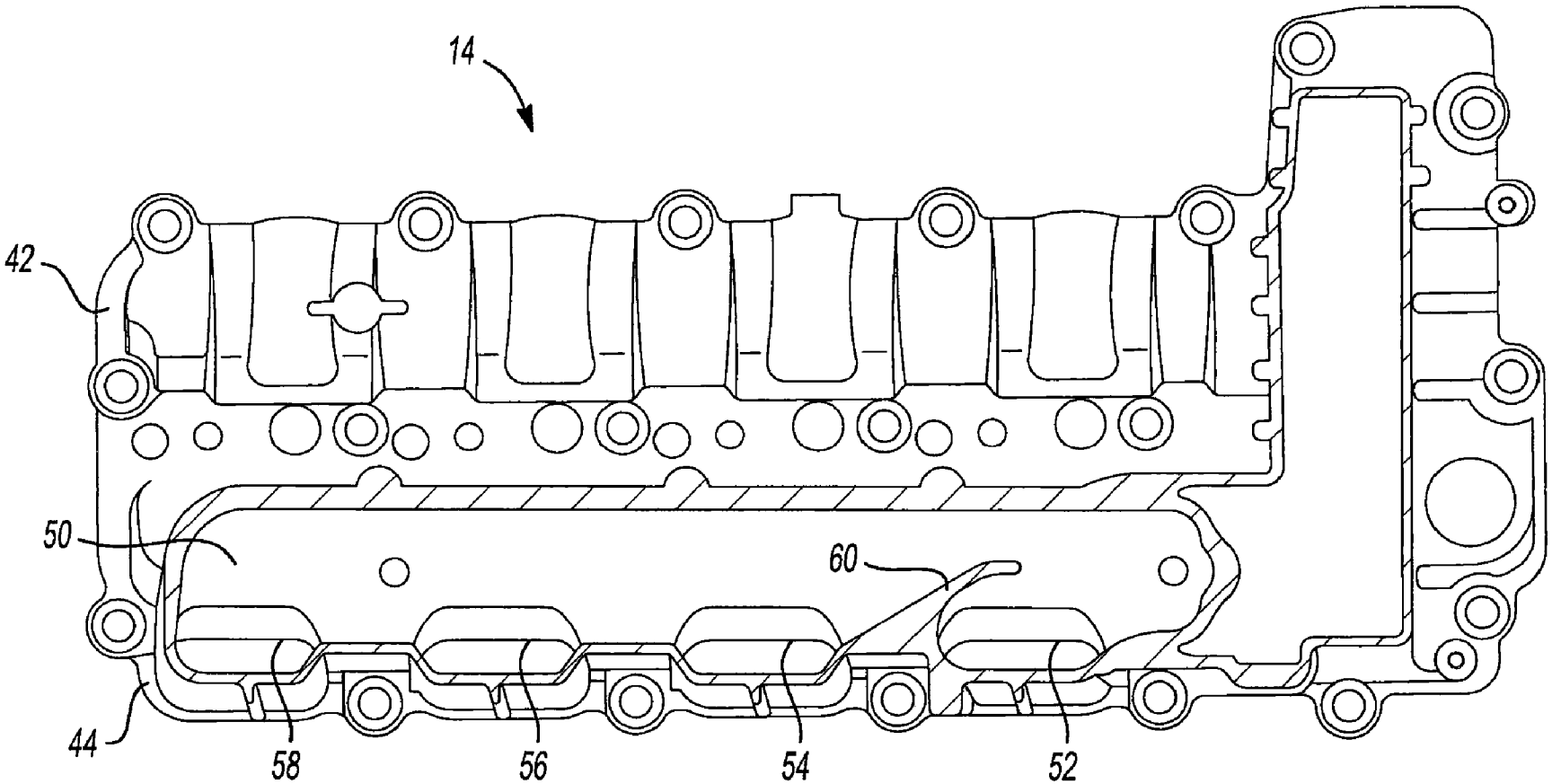
FIG. 5 is a section view of the cover member shown in FIG. 3.

The first and second cover members 14, 15 may be generally similar to one another. Therefore, the first cover member 14 will be described with the understanding that the description applies equally to the second cover member 15. With additional reference to FIGS. 3-5, the first cover member 14 may include a first portion that forms a cam cover portion 42 and a second portion that forms an intake manifold portion 44 to form an integrated cam cover/intake manifold. The orientation of the cam cover portion 42 and the intake manifold portion 44 of the cover member 14 relative to the engine block 20 is schematically illustrated in FIG. 1. The first cover member 14 may be a one-piece part. For example, the first cover member 14 may be a one-piece aluminum part and may be formed from an aluminum casting, such as a semi-permanent aluminum casting.

The cam cover portion 42 may overly the valvetrain assembly 26 that is located on the first cylinder head 22 and isolate the valvetrain assembly 26 from a location that is external to the engine assembly 10. The cam cover portion 42 may include a first cavity 46 that covers the intake camshaft 34 and the intake valves 38 and a second cavity 47 that covers the exhaust camshaft 36 and the exhaust valves 40. The intake manifold portion 44 may form an intake manifold and may include an air inlet 48, an air distribution member 50, and intake manifold ports 52, 54, 56, 58. The air inlet 48 may be in communication with the air intake plenum 16 and the air distribution member 50. The air distribution member 50 may define a cavity that is in communication with the air inlet 48 and the intake manifold ports 52, 54, 56, 58.

The air distribution member 50 may include features to provide a desired air flow condition to the intake manifold ports 52, 54, 56, 58. For example, a rib 60 may be located within the air distribution member 50 and may extend into the cavity near the manifold port 52 that is closest to the air inlet 48 in order to direct air flow and provide even air distribution between the manifold ports 52, 54, 56, 58. The intake manifold ports 52, 54, 56, 58 may each be in communication with one of the intake ports 30 in the first cylinder head 22. The intake manifold portion 44 may be isolated from the cam cover portion 42 through the use of a gasket (not shown) located within the channel 62 on the lower surface of the first cover member 14 to provide sealed communication between the intake manifold ports 52, 54, 56, 58 and the intake ports 30.

What is claimed is:

1. An engine assembly comprising:

an engine block including a first bank defining a first set of cylinders and a second bank defining a second set of cylinders that is disposed at an angle relative to the first set of cylinders to form a V-configuration;

a first cylinder head fixed to the first bank and including a first set of head intake and exhaust ports, the first set of head exhaust ports being located in an inboard side of the first cylinder head proximate a center of the V-configuration;

a second cylinder head fixed to the second bank and including a second set of head intake and exhaust ports, the second set of head exhaust ports being located in an inboard side of the cylinder head proximate a center of the V-configuration;

a first valvetrain cover fixed to the first cylinder head and including a first air inlet in communication with the first set of head intake ports; and a second valvetrain cover fixed to the second cylinder head and including a second air inlet in communication with the second set of head intake ports.

2. The engine assembly of claim 1, wherein the first valvetrain cover includes a first intake manifold portion that includes a first set of intake manifold ports in communication with the first set of head intake ports and the first air inlet forms an intake manifold inlet that is in communication with the first set of intake manifold ports.

3. The engine assembly of claim 2, wherein the first valvetrain cover includes a first cam cover portion that isolates a valvetrain located within the first cylinder head from a location external to the engine assembly.

4. The engine assembly of claim 3, wherein the first intake manifold portion includes an air distribution member that defines a cavity in communication with the first air inlet and the first set of intake manifold ports.

5. The engine assembly of claim 4, wherein the air distribution member includes a rib extending into the cavity to direct an air flow within the cavity.

6. The engine assembly of claim 3, wherein the first cam cover portion is isolated from the first intake manifold portion.

7. The engine assembly of claim 3, wherein the first intake manifold portion and the first cam cover portion of the first valvetrain cover are formed as a single cast member.

8. The engine assembly of claim 7, wherein the single cast member includes an aluminum casting.

9. The engine assembly of claim 1, further comprising an intake plenum having first and second conduits extending therefrom, the first conduit being in communication with the first air inlet and the second conduit being in communication with the second air inlet.

10. The engine assembly of claim 1, wherein the first valvetrain cover forms a first intake manifold and the second valvetrain cover forms a second intake manifold.

11. The engine assembly of claim 9, further comprising an exhaust manifold located between the first and second banks of the V-configuration.

12. An engine assembly comprising:

an engine block including a first bank defining a first set of cylinders and a second bank defining a second set of cylinders;

a first cylinder head fixed to the first bank and including a first set of head intake and exhaust ports;

a second cylinder head fixed to the second bank and including a second set of head intake and exhaust ports, the first and second sets of head exhaust ports facing one another and the first and second sets of head intake ports facing away from one another;

a first valvetrain cover fixed to the first cylinder head and defining a first intake manifold portion in communication with the first set of head intake ports and a first cam cover portion integrally formed with the first intake manifold portion and isolated from the first set of head intake ports; and a second valvetrain cover fixed to the second cylinder head and defining a second intake manifold portion in communication with the second set of head intake ports and a second cam cover portion integrally formed with the second intake manifold portion and isolated from the second set of head intake ports.

13. The engine assembly of claim 12, wherein the first and second sets of cylinders are disposed at an angle relative to one another to form a V-configuration, the first and second sets of head exhaust ports being located proximate a center of the V-configuration.

14. The engine assembly of claim 13, further comprising an exhaust manifold located between the first and second banks of the V-configuration.

15. The engine assembly of claim 12, wherein the first intake manifold portion includes a first air inlet, a first set of intake manifold ports in communication with the first set of head intake ports, and an air distribution member that defines a cavity in communication with the first air inlet and the first set of intake manifold ports.

16. The engine assembly of claim 15, wherein the air distribution member includes a rib extending into the cavity to direct an air flow within the cavity.

17. The engine assembly of claim 12, wherein the first intake manifold portion and the first cam cover portion are formed as a single cast member.

18. The engine assembly of claim 17, wherein the single cast member includes an aluminum casting.

19. The engine assembly of claim 12, further comprising an intake plenum having first and second conduits extending therefrom, the first conduit being in communication with the first air inlet and the second conduit being in communication with the second air inlet.

* * * * *